United States Patent [19]

Facchini

[11] 4,235,443

[45] Nov. 25, 1980

[54] BOARD GAME WITH DIRECTIONAL INDICATOR

[76] Inventor: Giovanni C. Facchini, 17 Gordon Ter., Ayr, Ayshire, Scotland, KA8 OEF

[21] Appl. No.: 942,780

[22] Filed: Sep. 15, 1978

[30] Foreign Application Priority Data

Oct. 6, 1977 [GB] United Kingdom ..... 41665/77

[51] Int. Cl.[3] ..... A63F 3/00

[52] U.S. Cl. ..... 273/277

[58] Field of Search ..... 273/244, 277, 282

[56] References Cited

U.S. PATENT DOCUMENTS 795,822 8/1905 Darius ..... 273/282 X

FOREIGN PATENT DOCUMENTS 1187095 4/1970 United Kingdom ..... 273/146

1276868 6/1972 United Kingdom ..... 273/288

1279239 6/1972 United Kingdom ..... 273/244

*Primary Examiner*—Richard C. Pinkham

*Assistant Examiner*—Scott L. Brown

*Attorney, Agent, or Firm*—Auslander, Thomas & Morrison

[57] ABSTRACT

A game with a board having two long and two short sides with "pocket" areas at the corners and at the middle of the two long sides, as in pocket billiards or snooker, markers representing balls and a special direction indicator having pointers correlated with a chance device. Directional indicator being engageable with the game board at the pocket areas for attempting to "pocket" markers placed next to the pocket areas. Markers representing balls have retainers on the game board with at least one retainer adjacent each pocket area.

5 Claims, 4 Drawing Figures

BOARD GAME WITH DIRECTIONAL INDICATOR

This invention relates to apparatus for playing a game.

According to the present invention there is provided apparatus for playing a game, comprising a generally rectangular board having at each corner and half-way along each of its longer sides areas represented pockets, a number of markers movably locatable on the board to represent balls, and means for randomly selecting any one of the pocket areas.

The apparatus includes means for indicating the direction of play, which may be in the form of a body having thereon three pointers set at an angle of 120° to one another around the body. The body is preferably elongate and engageable individually with holes or recesses in the pocket areas of the board. The direction indicator is marked in a manner corresponding with the random selection means to indicate future direction of play in response to an indication by the random selection means.

The board may have retainers for receiving and locating the markers, at least some of the retainers being disposed adjacent each pocket area. The retainers may be for example holes or projections for engagement with the markers.

The indicating means may have each of its pointers associated with two numerals or two letters, and a six-sided die may be provided as the random selection means with one of said numbers or letters on each side thereof.

The game may be played in accordance with the rules hereinafter described.

An embodiment of the present invention will now be described, by way of example, with reference to the accompanying drawings, in which.

Figure 1:
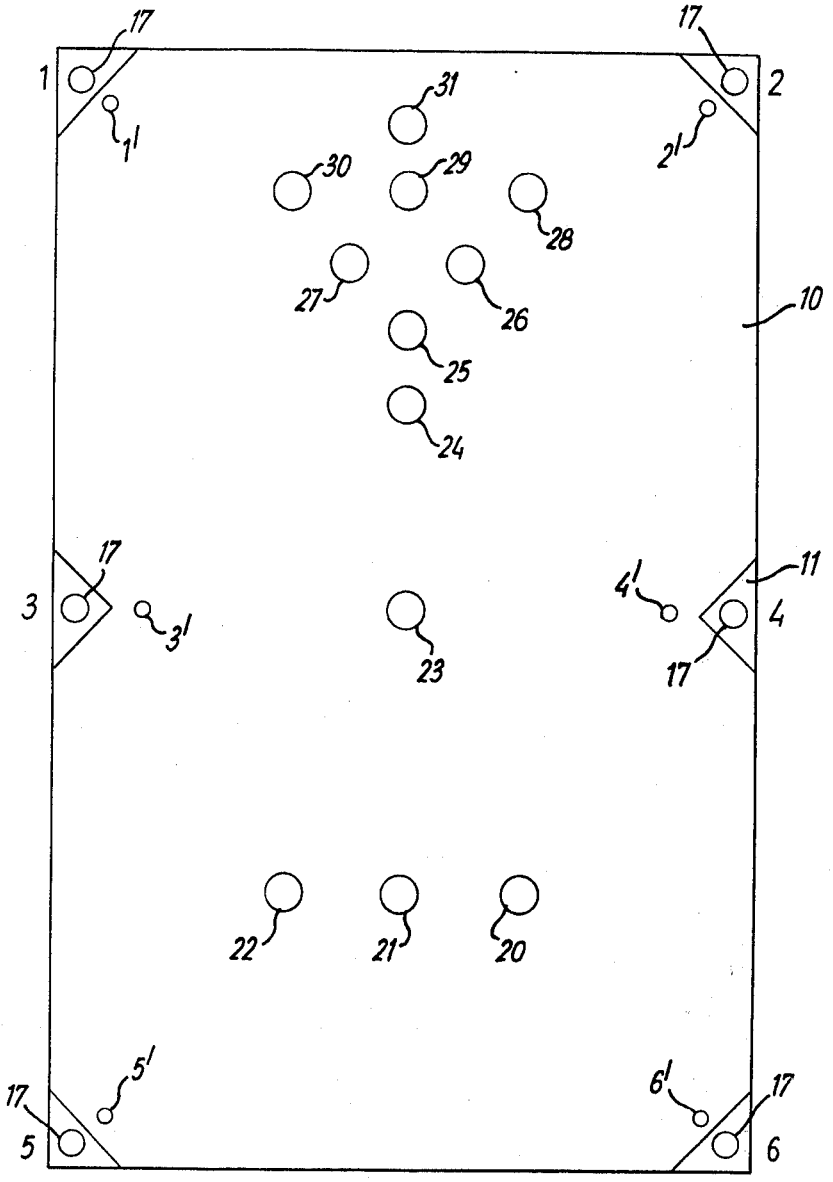
FIG. 1 shows a plan view of the board for a game according to the present invention.

The apparatus of this embodiment of the invention has a rectangular board 10 having areas 11 at each corner and in the middle of the longer sides so as to represent pockets, each of which is identified either by means of a reference number or a reference letter; in this case the reference numerals 1 to 6 have been utilised. The areas representing the pockets can be indicated on the board either by markings, for example printing, or alternatively by means of metal inserts on the board 10. The board 10 is preferably covered with green baize so as to resemble a snooker table.

Holes which are designated in FIG. 1 by the reference numerals 1' to 6' are provided adjacent each of the pockets 11 and twelve other holes are provided in the board in the pattern shown in FIG. 1; these holes have been designated by the reference numerals 20 to 31. Twelve markers are provided in the form of coloured pegs, there being one yellow, one brown, one green, one blue, one pink, six red and one black peg. Each of the pegs represents a target ball in snooker and has extending from it a pin which locates it in any of the holes provided in the board.

Figure 2:
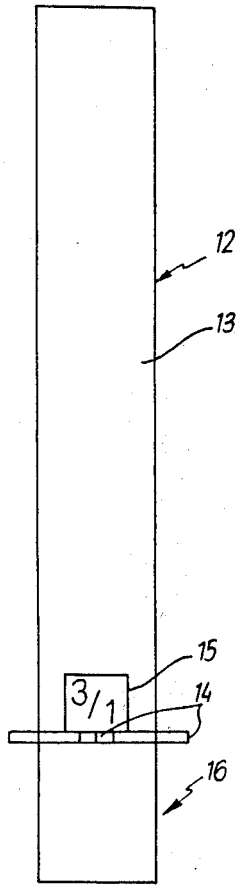
FIG. 2 is a perspective view of a cue for use in the game according to the present invention.

A "cue" 12 is provided as shown in FIG. 2 and comprises a length of dowelling 13 having three pointers 14 extending substantially radially therefrom and spaced at an angle of 120° to each other. Each of the pointers is designated at 15 by two numerals selected from the numbers 1 to 6. The bottom end 16 of the cue is adapted to be retained in any one of holes 17 provided in each of the pocket areas.

A six-sided die is also provided, the sides of the die being marked with reference numbers or letters corresponding to the six numbers on the cue and one to each of the numbered or lettered pockets.

In use, the pegs are positioned initially substantially as in snooker with the coloured balls being placed in the holes 20–31 in the same arrangement as the balls would be laid out before starting a game of snooker, i.e. with the red balls in the holes 25 to 30, the yellow, brown and green balls in the holes 20, 21 and 22 and the blue, pink and black balls in the holes 23, 24 and 31, respectively.

Figure 3:
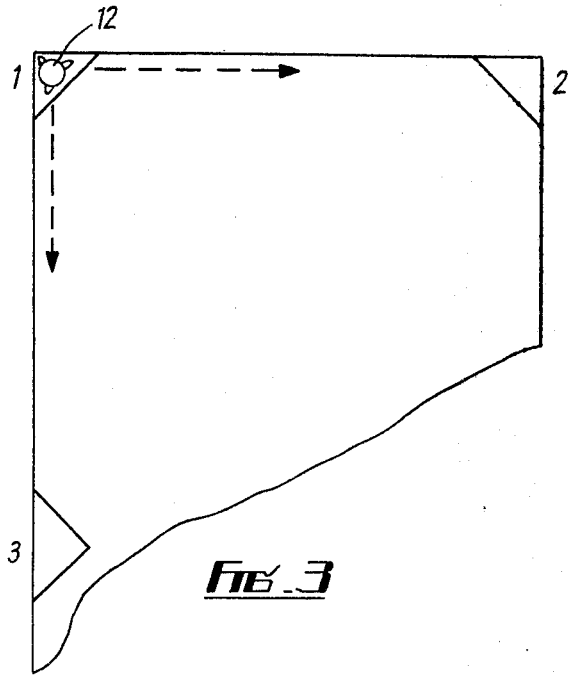
FIG. 3 is a detailed view showing the cue in position on one of the corner pockets.

The game is played by two players and the first player starts the game by throwing the die and moves any red peg into the hole adjacent the pocket of the number shown by the throw of the die, e.g. to pocket number 1 as shown in FIG. 3. The second player then inserts the cue in the hole 17 of the pocket 1 and selects which pointer 14 is pointing into the pocket, i.e. by means of the reference numerals at 15. The first player throws the die again and if the number thrown corresponds to either of the numbers on the pointer pointing into the pocket the red is potted and a point is awarded to the first player. Alternatively, if the number thrown corresponds to either of the other pointers then the red ball is moved to an adjacent pocket in the direction of the pointer with the number which has been thrown and the first player's break is completed. If the first player has potted his red then his break continues by selecting a colour, each colour having a point value in accordance with the normal rules of snooker. If the first player in continuing his break selects black he throws the die and moves the black ball to the appropriate pocket whereupon the second player places the cue in that pocket in the same manner as before. The first player then throws the die again to establish whether or not he has potted the black or moved the black to another pocket. If the black or any other colour is not potted then it remains in the hole outside the appropriate pocket and if another player throws for another peg the number corresponding to that pocket then it is considered as an accidental potting of the black and the appropriate player's score is amended accordingly in the same manner as in the real game of snooker. In a slightly simpler form of the game the colours which are selected for potting after potting a red are limited in accordance with the pocket into which the red has been potted. Thus, the black can only be selected after potting a red in pocket 1 or 2, the pink and blue after potting in pocket 3 or 4, and the yellow, green and borwn after potting in pocket 5 or 6.

Figure 4:
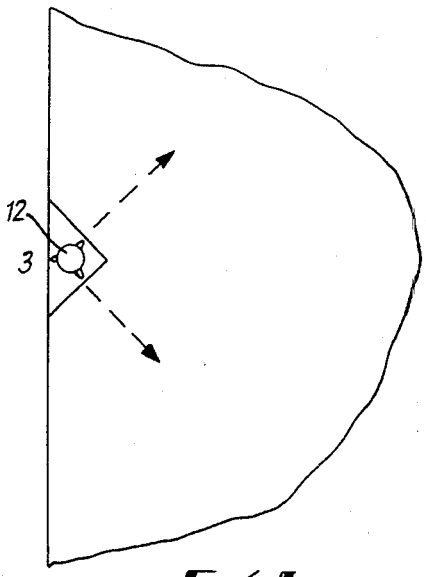
FIG. 4 is a view corresponding to FIG. 3 and showing the cue on one of the middle pockets.

The game proceeds in the above manner with each player accumulating a point score until all the reds are potted, the coloured "balls" being then potted in the order set by the normal rules of snooker. FIGS. 3 and 4 show in broken lines the various directions in which the ball can be moved from one pocket to another if potting is not achieved.

It will be appreciated that the same equipment can be used for playing games of pool and billiards with only minor modification of the rules.

Improvements or modifications may be made without departing from the scope of the present invention.

What I claim is:

1. Apparatus for playing a game comprising a generally rectangular board having long and short sides, said board having at each corner and halfway along each of said long sides areas representing pockets, a plurality of markers representing balls, said markers movably locatable on said board, and a direction indicator having markings for selectively indicating the location of any of said pocket areas and for selection of the direction of play after selection of one of said pocket areas, random selection means, said random selection means for selecting any of said pocket areas and the direction of play after the selection of said pocket area, said random selection means including markings mutually corresponding to said direction indicator markings.

2. Apparatus according to claim 1, wherein said direction indicator is a body having three pointers set at an angle of 120° to one another around said body.

3. Apparatus according to claim 2, wherein said random selection means is a six-sided die and said direction indicator is marked so that each of its pointers corresponds to two faces of the die.

4. Apparatus according to claim 1, 2 or 3, wherein at least an end portion of said direction indicator is elongate and engagable individually with holes in said pocket areas of the board.

5. Apparatus according to claim, 1, 2 or 3, wherein said board includes retainers for receiving and locating said markers, at least some of the retainers being located one adjacent each pocket area.

* * * * *